US008579127B2

(12) United States Patent
Dyck

(10) Patent No.: US 8,579,127 B2
(45) Date of Patent: Nov. 12, 2013

(54) CLOSET ORGANIZER SHELVING SYSTEM

(76) Inventor: Henry V. Dyck, West Kelowna (CA)

( * ) Notice: Subject to any disclaimer, the term of this patent is extended or adjusted under 35 U.S.C. 154(b) by 93 days.

(21) Appl. No.: 13/317,938

(22) Filed: Nov. 1, 2011

(65) Prior Publication Data

US 2013/0105426 A1 May 2, 2013

(51) Int. Cl.
*A47F 5/08* (2006.01)

(52) U.S. Cl.
USPC ..... 211/134; 211/87.01; 211/103; 211/193

(58) Field of Classification Search
CPC ..... A47F 5/0018; A47F 5/103; A47F 5/0081; A47B 45/00; A47B 55/00; A47B 96/02; A47B 96/022; A47B 96/024; A47B 96/027; A47B 96/028; A47B 96/06; A47B 96/065; A47B 96/066; A47B 96/1425; A47B 96/1458; A47B 96/1475; A47B 47/0025; A47B 47/0083; A47B 47/0091; A47B 47/021; A47B 47/03
USPC ..... 211/134, 189, 87.01, 193, 103, 187, 211/190; 108/106, 107, 29, 193, 109, 108/147.11, 147.16; 312/245, 263, 351, 312/203, 107, 108, 7.2; 248/218.4, 219.3, 248/235, 239, 241–243, 250
See application file for complete search history.

(56) References Cited

U.S. PATENT DOCUMENTS

| | | | | | |
|---|---|---|---|---|---|
| 3,513,786 | A | | 5/1970 | Kellogg | |
| 3,908,831 | A | * | 9/1975 | Brendgord | 211/88.01 |
| 4,540,222 | A | * | 9/1985 | Burrell | 312/257.1 |
| 4,928,833 | A | * | 5/1990 | Huizenga | 211/187 |
| 5,191,986 | A | * | 3/1993 | Huizenga | 211/189 |
| 5,582,306 | A | * | 12/1996 | Balter et al. | 211/187 |
| 5,601,016 | A | * | 2/1997 | Witte | 108/106 |
| 6,681,941 | B1 | * | 1/2004 | Johnson | 211/86.01 |
| 6,896,341 | B2 | * | 5/2005 | Cattoire | 312/205 |
| 7,083,056 | B2 | * | 8/2006 | Routhier | 211/90.04 |
| 7,384,107 | B2 | * | 6/2008 | Humberto | 312/245 |
| 7,387,212 | B2 | | 6/2008 | Costa et al. | |
| 7,673,762 | B2 | * | 3/2010 | Humberto | 211/186 |
| 8,117,972 | B2 | * | 2/2012 | Winget et al. | 108/108 |
| 2003/0150830 | A1 | * | 8/2003 | Crown et al. | 211/175 |
| 2005/0161419 | A1 | * | 7/2005 | Lawson et al. | 211/189 |
| 2009/0079308 | A1 | * | 3/2009 | Punzel et al. | 312/306 |

* cited by examiner

*Primary Examiner* — Jennifer E Novosad
(74) *Attorney, Agent, or Firm* — Antony C. Edwards

(57) ABSTRACT

Shelves and other load supporting panels are releasably mountable between pairs of uprights by sandwiching the rear ends of the panels between an upper, rear mounting bracket and a lower, forward mounting bracket at each end of the panels. Each pair of upper and lower mounting brackets are mounted to an upright so as to be in opposed facing relation to another pair of upper and lower mounting brackets or an adjacent upright. A protuberance on one mounting bracket of each pairs engages into a corresponding indentation on the panel to prevent the panel being inadvertently slid outwardly horizontally from its position cantilevered from between the uprights.

16 Claims, 12 Drawing Sheets

Fig 9c
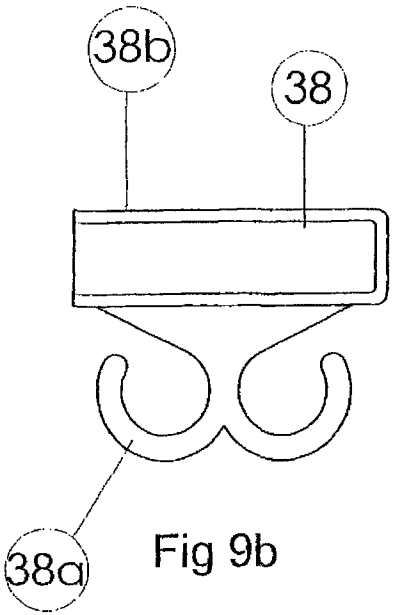
Fig 9b
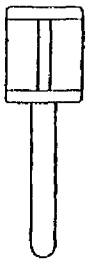
Fig 9a

CLOSET ORGANIZER SHELVING SYSTEM

FIELD OF THE INVENTION

This invention relates to the field of closet organizers and in particular to an improved modular closet organizing system employing simplified mounts for cantilevered interchangeable mounting of shelving, drawer, cubicles and the like onto a vertical array of parallel uprights.

BACKGROUND OF THE INVENTION

In the prior art, Applicant is aware of U.S. Pat. No. 7,673,762 which issued to Humberto on Mar. 9, 2010, wherein Humberto discloses a modular system for use in a closet or dressing room which may be optimized to use the available space and wherein one or more vertical uprights are supported within the walls of an enclosure by horizontal rods, and wherein horizontal shelving is mounted between the uprights.

Applicant is also aware of U.S. Pat. No. 7,387,212 which issued to Costa et al. on Jun. 17, 2008, wherein Costa et al. disclose the use of vertical uprights and a top rail assembly wherein the distance between the vertical uprights may be adjusted and where a plurality of covers having a predetermined length correctly space uprights hung from the top rail.

Applicant is also aware of U.S. Pat. No. 7,083,056 which issued to Routhier on Aug. 1, 2006, wherein Routhier describes a storage organizer system which includes a horizontal rail which is mounted to a wall and a number of storage units which are hung from the rail, wherein the storage units hang from the rail by metal hooks.

Applicant is also aware of U.S. Pat. No. 5,601,016 which issued to Witt on Feb. 11, 1997, wherein Witt discloses a suspended shelf system which includes suspension members which are secured to a track member so that each suspension member hangs vertically from the track member and wherein a connecting rail mounts between the suspension members so as to maintain the suspension members in their spaced apart relation, and wherein the track member is mounted to a supporting structure.

Applicant is also aware of U.S. Pat. No. 3,513,786 which issued to Kellogg on May 26, 1970, wherein Kellogg discloses a plurality of vertical support members wherein mounting brackets mount to the support members by means of projections on the rear end of the brackets fitting into slots in the support members, a plurality of shelf segments mounting onto the brackets to provide shelving.

SUMMARY OF THE INVENTION

The storage system according to one aspect of the present invention may be characterized as including at least first and second uprights, wherein each upright has vertically extending front and rear edges and a pair of side faces extending between the front and rear edges. A spaced apart array of substantially identical groups of holes are formed along at least one of the pair of side faces on each upright Each group of groups of holes includes at least one receiving stub-shaft receiving aperture and one fastener aperture. The groups of holes in the array are alternatingly staggered along each of the uprights so that, counting downwardly from an upper, first group of holes located adjacent the rear edge of each upright, a second group of holes is located adjacent the front edge and at an elevation which is lower than the first group of holes by a first vertical spacing. The first vertical spacing corresponds generally to the thickness of a shelf or panel. A third group of holes is located adjacent the rear edge of each upright and at an elevation which is lower than the second group by a second vertical spacing. The second vertical spacing may be greater than the first vertical spacing to allow for spacing between shelves, drawer supports, storage cubicles, shoe storage panels, etc. A fourth group of holes is located adjacent the front edge and at an elevation which is lower than the third group by again, the first vertical spacing.

A plurality of sets of mounting brackets are mounted, or mountable when the system is supplied as a kit, into the groups of holes in the uprights. Each set of mounting includes at least four mounting brackets. Each mounting bracket within each set of mounting brackets includes a base member, a stub-shaft extending from the base member, and at least one fastener aperture. In alternative embodiments, the fastener aperture may be omitted when the bracket fastener doesn't require a bolt or screw hole or the like, for example: If the bracket is adhesively fastened to the uprights. The stub-shaft is sized for snug fitment into the stub-shaft receiving apertures in the uprights so as to mount the mounting bracket against the upright and so as to serve as a shear-force resisting member. The base member is mounted against a corresponding side face of the corresponding upright so that the stub-shaft is journalled fully into the corresponding stub-shaft receiving aperture. A fastener such as a screw may be mounted through the fastener aperture in the base member and into the corresponding fastener receiving aperture in the upright so as to fasten the bracket to the upright and so as to maintain the mounting bracket vertical or otherwise properly aligned for its function, the bracket has an uppermost end and an opposite lowermost end.

At least one planar shelf or load supporting panel is mounted between a pair of upper and lower mounting brackets on either side of the shelf or panel. Each shelf or panel has a pair of side edges at opposite sides thereof. Each side edge has a channel or an indentation formed on the panel adjacent a corresponding side edge. A rear edge and an opposite front edge of the shelf or panel extend between the pair of side edges. At least one of the upper and lower ends of the base member has a protuberance thereon which mates into the corresponding indentation on the shelf or panel, hereinafter collectively referred to as a panel.

With one set of mounting brackets mounted to corresponding first and second groups of holes, and with the rear edge of the panel inserted between the mounting brackets when mounted into the first and second groups of holes, and because the panel thickness corresponds to the first vertical spacing, the panel snugly fits into the first vertical spacing. With the rear edge of the panel substantially flush with the rear edges of the uprights, an upper surface of the panel adjacent the rear edge of the panel abuts upwardly against the lowermost ends of the mounting brackets mounted to the first group of holes and a lower surface of the panel adjacent the rear edge of the panel abuts downwardly against the uppermost ends of the mounting brackets mounted to the second group of holes. The protuberances are mated into the corresponding receiving indentations on the panel.

Where the panels are shelves, the first vertical spacing is substantially the shelf thickness, and the second vertical spacing includes spacing between a vertically adjacent pair of the shelves.

Advantageously each vertical upright is a beam. The beam may be substantially a rectangular parallelepiped. Each group of holes may include at least two and in one embodiment three vertically spaced apart holes. The holes may be substantially vertically aligned one over the other. A centre hole may be the stub-shaft receiving aperture.

In one embodiment the protuberance is only on the uppermost ends of the base members. The protuberance may be a stub-like projection, or may be formed as a ridge extending transversely of the base member when mounted to the upright so that the ridge extends outwardly of a corresponding side face of the upright.

Advantageously each set of mounting brackets includes two opposed-facing pairs of the mounting brackets mounted to opposed-facing side faces on the uprights. The apertures may be bores extending completely through the uprights. The beam may have a beam thickness extending completely through the beam from one the side face to the other side face. The beam has a length from a top end of the beam to a bottom end of the beam. The beam has a depth orthogonal to the thickness of the beam and the length of the beam. The front and rear edges of the beam are spaced apart by the beam depth. The two opposed-facing pairs of mounting brackets include an upper pair of mounting brackets and a lower pair of mounting brackets. The upper and lower pairs of mounting brackets are spaced apart across the beam by substantially the depth of the beam.

The panel may be a planar shelf extending between a pair of the uprights completely from one upright to the other, adjacent upright, and cantilevered from the uprights.

Advantageously the shelf is cantilevered substantially horizontally. A plurality of the shelves may be mounted between corresponding sets of mounting brackets mounted to the apertures in the uprights. Additional uprights and additional shelves may be mounted to, so as to extend between adjacent uprights on corresponding sets of brackets.

BRIEF DESCRIPTION OF THE DRAWINGS

FIG. 9*a* is, in left side elevation view, a shelf connector clip having a pair of hooks depending therefrom.

FIG. 9*b* is, in front elevation view, the clip of FIG. 9*a*.

FIG. 9*c* is, in right side elevation view, the clip of FIG. 9 *b*.

DETAILED DESCRIPTION OF EMBODIMENTS OF THE INVENTION

Figure 5B:
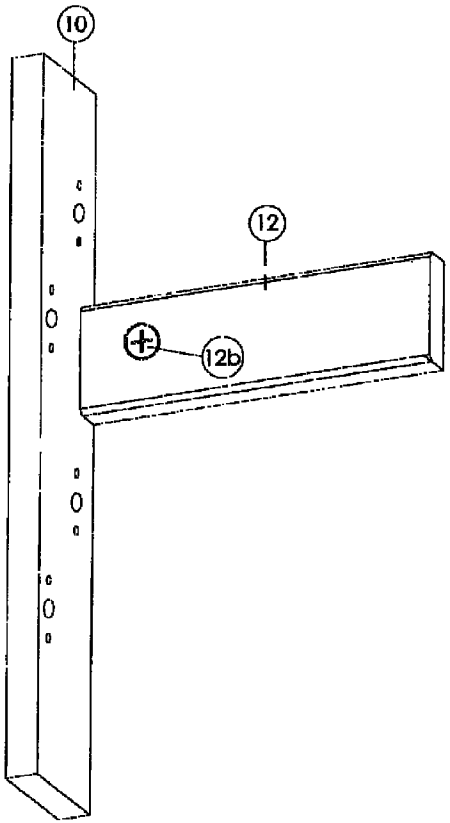
FIG. 5*b* is the view of FIG. 5*a* showing the cross-member mounted to the upright.
Figure 5A:
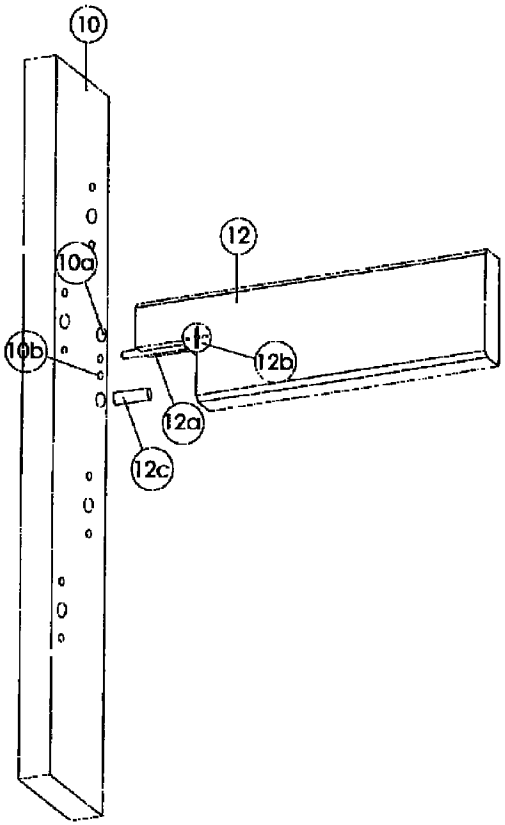
FIG. 5*a* is, in partially cut-away perspective view, a partially cut-away section through one end of a cross-member showing the mounting arrangement for mounting the cross-member to the vertical upright
Figure 6:
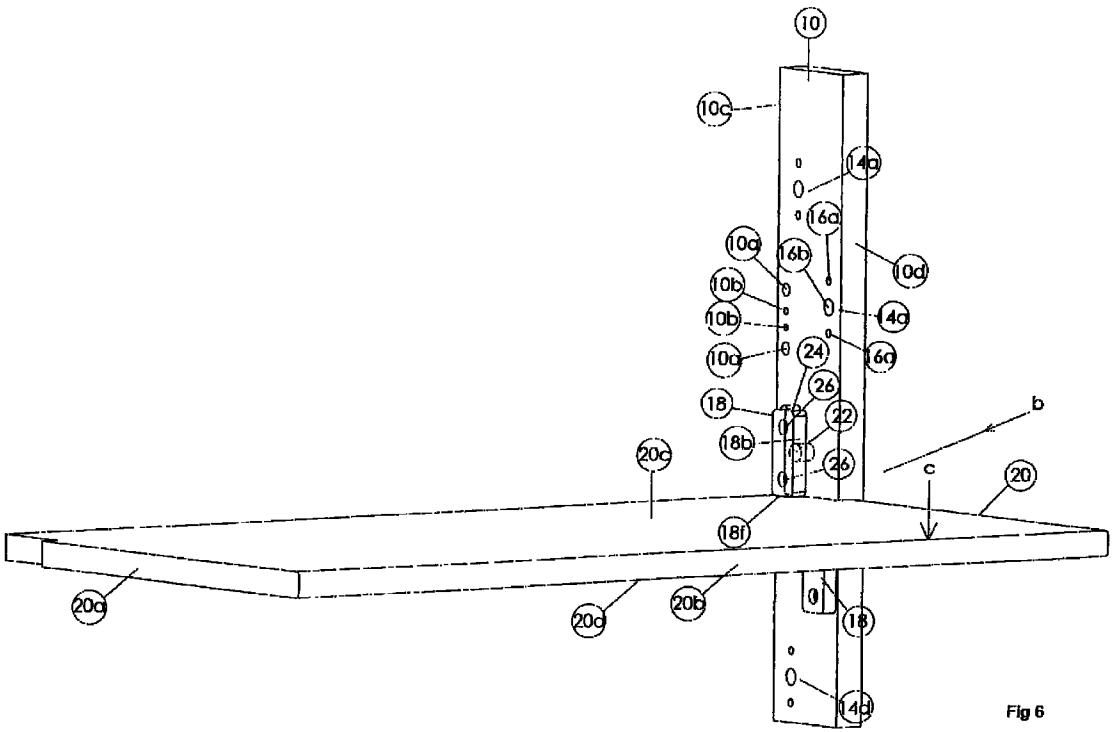
FIG. 6 is, in partially cut-away perspective view, a partial shelf mounted between upper and lower mounting brackets, themselves mounted to a section of vertical upright.
Figure 6A:
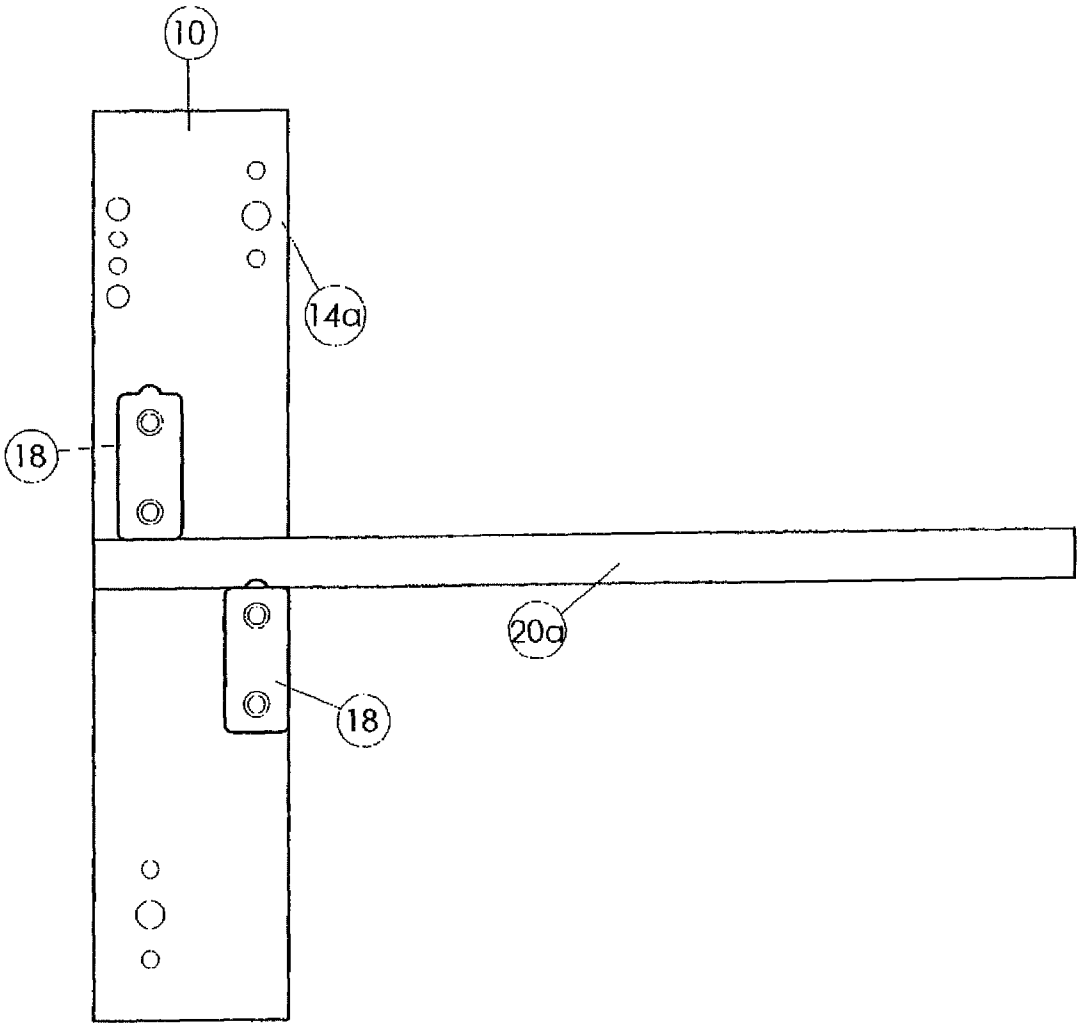
FIG. 6*a* is, in side elevation view, the view of FIG. 6.

As seen in the accompanying figures wherein like reference numerals denote corresponding parts in each view, the closet organizer shelving system includes a plurality of vertical uprights 10 braced and spaced apart by horizontally extending. cross members 12. Cross members 12 may be mounted to uprights 10 in a conventional fashion such as seen in FIG. 5*a* by means of bolts 12*a* through corresponding holes 10*a* mounting into threaded receivers 12*b* inserted into the ends of cross members 12. Alignment pins 12*c* mounted in the ends of cross members 12 fit into corresponding alignment holes 10*b* on uprights 10. Bolt holes 10*a* and alignment holes 10*b* are formed along the rear edge 10*c* of uprights 10.

Figure 1:
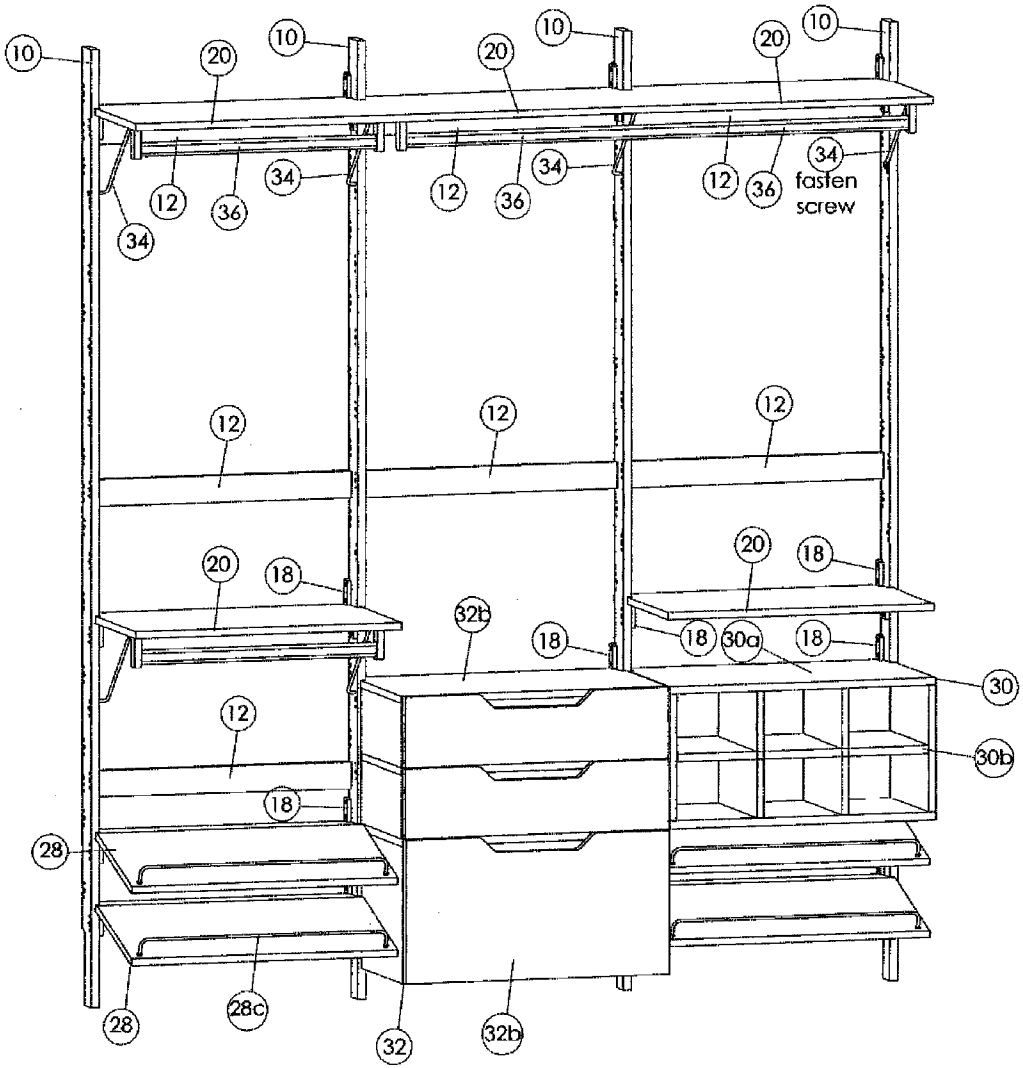
FIG. 1 is, in left side perspective view, a modular shelving or closet system according to one arrangement of the system having four vertical uprights and employing a plurality of horizontal shelves, inclined panels, drawers, and storage cubes.
Figure 2:
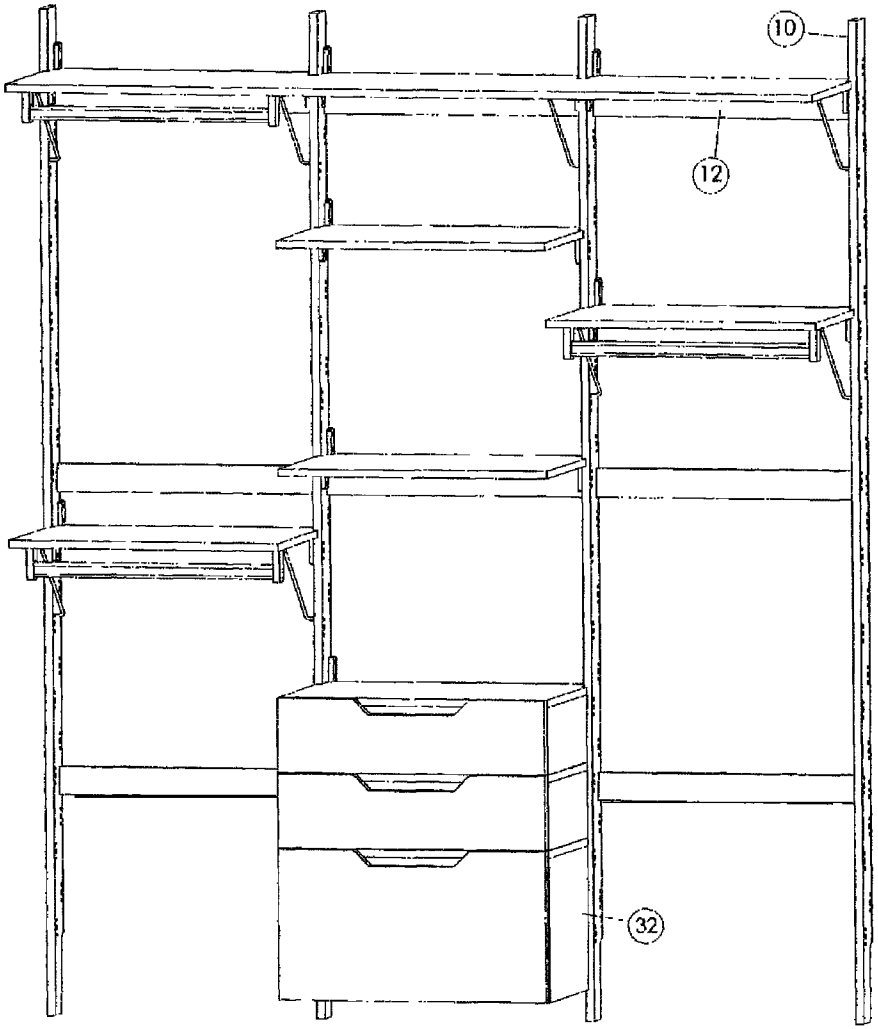
FIG. 2 is, in right side perspective view, the system of FIG. 1 with some of the shelves and panels rearranged and with the storage cubes removed.
Figure 3:
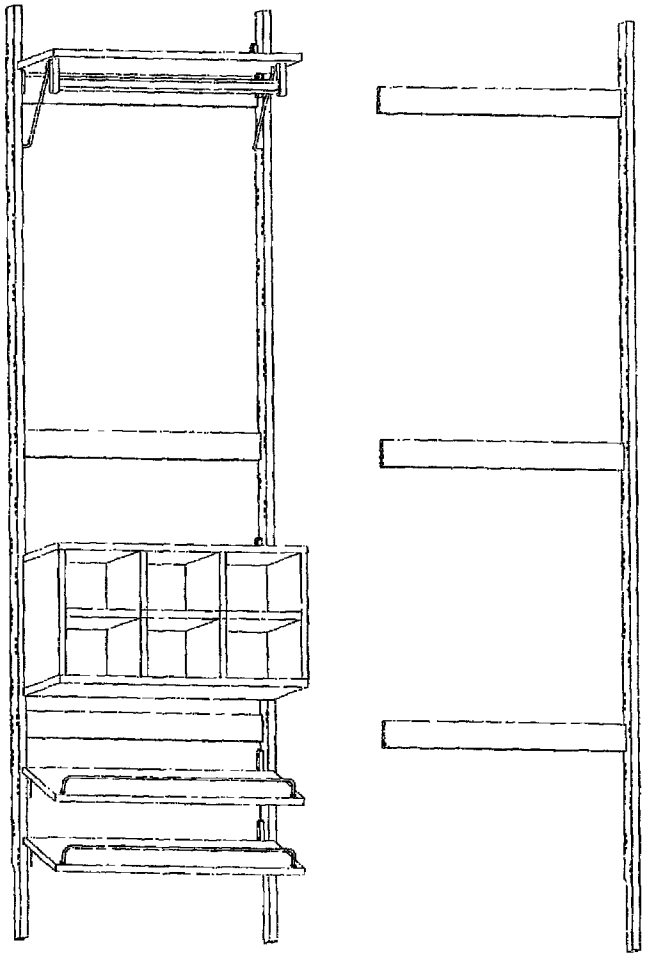
FIG. 3 is, in left side partially-exploded perspective view, a three upright embodiment showing the assembly of cross members to the centre upright and the use of shelves, inclined panels, and storage cubes.
Figure 4C:
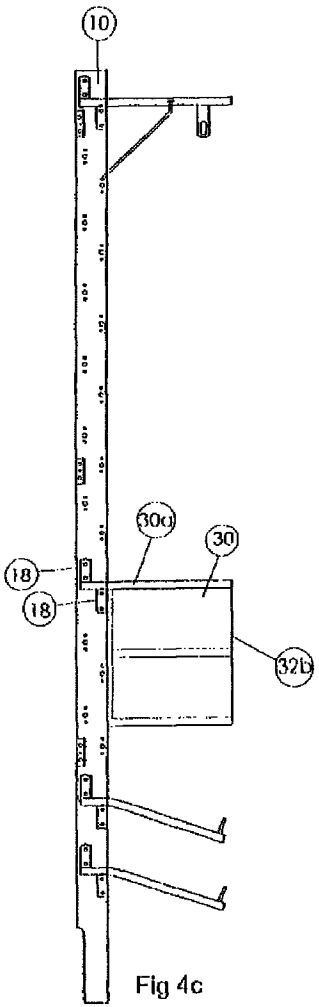
FIG. 4*c* is the view of FIG. 4*a* showing the suspension of storage cubes from a storage cube support mounted between pairs of mounting brackets on the uprights.
Figure 4B:
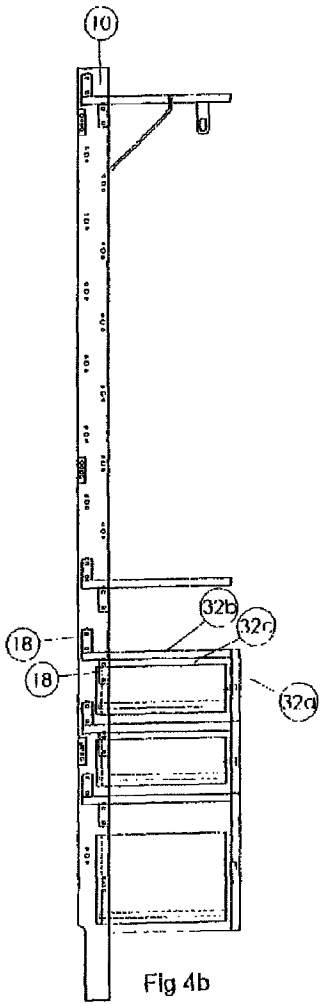
FIG. 4*b* is the view of FIG. 4*a* showing the suspension of drawers from horizontal drawer supports mounted between pairs of mounting brackets on the uprights.
Figure 4A:
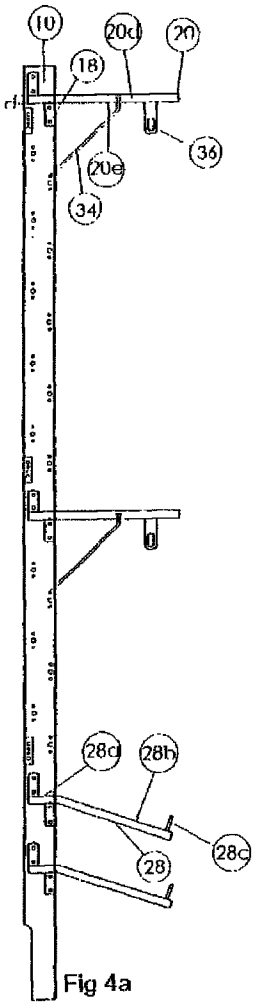
FIG. 4*a* is, in partially cut-away left side elevation view, a system employing upper and lower shelves, and a pair of lower inclined panels, wherein the upright closest to the viewer has been cut away so as to better illustrate the arrangement of alternating or staggered groups of holes and the use of mounting brackets mounted therein so as to support the shelves and panels sandwiched between pairs of mounting brackets.

Hole groups 14, for example consisting of holes 16*a* and 16*b*, are formed along the length of uprights 10, spaced along the length of each upright and alternating or staggered along the length so that a first hole group 14*a* of holes 16*a* and 16*b* are adjacent the front edge 10*d* of upright 10 and a second hole group 14*b* is adjacent rear edge 10*c*, and a third hole group 14*c* is adjacent front edge 10*d*, and a fourth hole group 14*d* is adjacent rear edge 10*c*, and so on. In preferred embodiments, the first hole group 14*a* is located at the top end of each upright 10 and is adjacent rear edge 10*c* such as seen in FIG. 2. The spacing between the uppermost hole group 14*a* and the second hole group 14*b* is such that, with mounting brackets 18 mounted to hole groups 14*a* and 14*b*, a horizontally extending shelf 20 may be mounted with the base end 20*a* of shelf 20 snugly and removably mounted between in spacing "a" mounting brackets 18 so as to cantilever the forward end 20*b* of shelf 20 from uprights 10.

Figure 7:
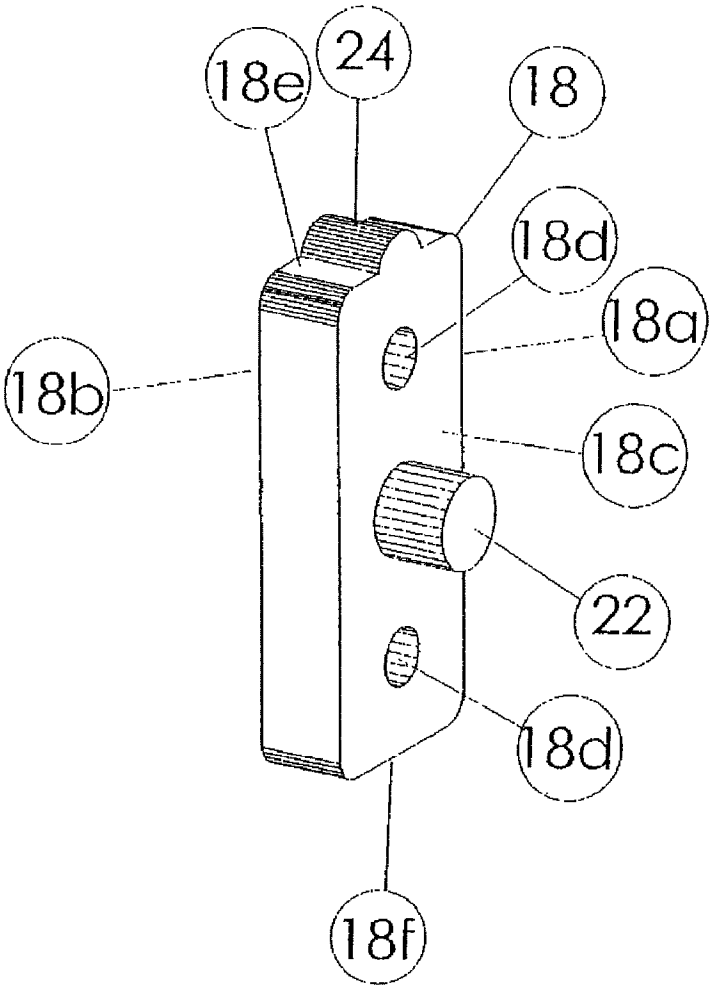
FIG. 7 is, in rear perspective view, one mounting bracket such as seen in front perspective view in FIG. 6.
Figure 7A:
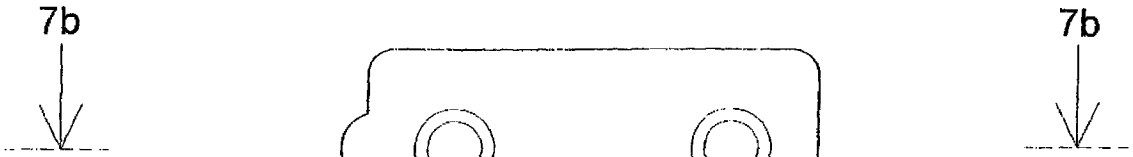
FIG. 7*a* is, in plan view, the front face of the mounting bracket of FIG. 7.
Figure 7B:
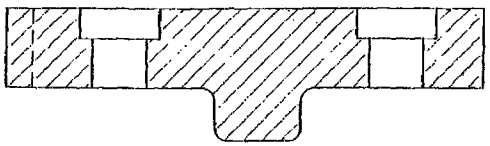
FIG. 7*b* is a sectional view along line 7*b*-7*d* in FIG. 7*a*.
Figure 8A:
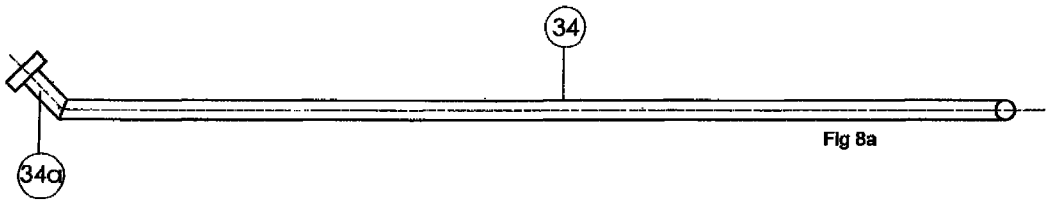
FIG. 8*a* is, in side elevation view, one bracing strut such as seen mounted between upper shelves and the vertical uprights in FIG. 2.
Figure 8B:
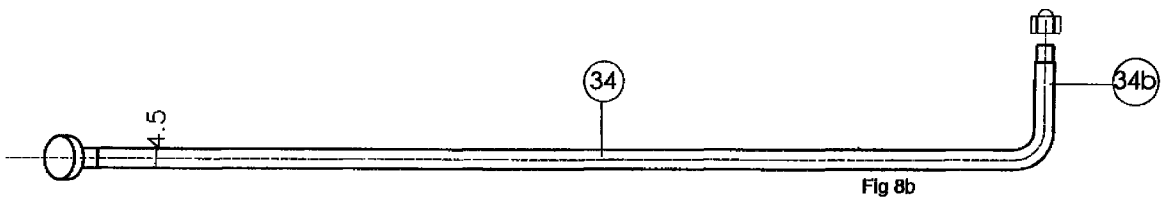
FIG. 8*b* is, in plan view, the strut of FIG.8 *a*.
Figure 9D:
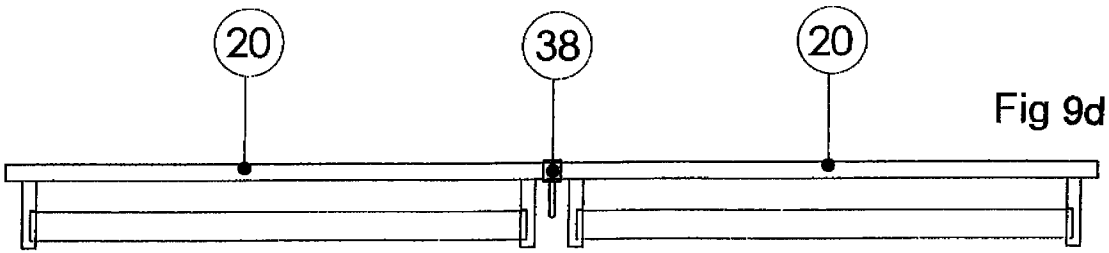
FIG. 9*d* is, in front elevation view, a pair of adjacent shelves, each having a rod suspended therefrom, and having the connector clip of FIG. 9*a* mounted between adjacent ends of the shelves.
Figure 9E:
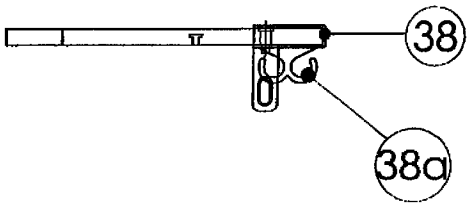
FIG. 9*e* is, in left side elevation view, the shelves and connector clip of FIG. 9*d*.

As better seen in FIGS. 7*a* and 7*b*, mounting brackets 18 include a generally planar base member 18*a* having a front face 18*b* and rear face 18*c*. Fastener receiving apertures such as sockets 18*d* are formed one in each end of base member 18*a*. A stub-shaft such as peg 22 is mounted to base member 18*a* or formed so as extend therefrom. A raised stub or locking ridge 24 is mounted to or formed on the upper end 18*e* of base member 18*a*. The opposite bottom end 18*f* of base member 18*a* is preferably planar. The corners of base member 18*a* may be bevelled. Otherwise, base member 18*a* may be in the form of a rectangular parallelepiped. Peg 22 may be cylindrical although this is not intended to be limiting.

In use, mounting brackets 18 mount into holes 16*a* and 16*b* for each hole group 14 needed to be used in order to support, as better described below, shelves, panels, cubes, or drawers, as desired by the user or the installer. Thus, in order to mount a mounting bracket to an upright 10, peg 22 is inserted into hole 16*b*, and base member 18 aligned vertically so as to align sockets 18*d* with holes 16*a*. Peg 22 is a snug fit into corresponding hole 16*b* so as to provide a shear resistance to the weight of a shelf 20, panel, cube, or the like, especially when supporting a load thereon. Fasteners such as screws 26 are inserted through sockets 18*d* so as to engage into and threadably mate with the walls of holes 16*a*.

With mounting brackets 18 mounted into the hole groups 14 that correspond to a spacing "a", shelf 20 may be inserted between the bottom end of the upper mounting bracket 18 and the lower end of the lower mounting bracket 18 so that the upper surface 20*c* snugs up against the bottom end 18*f* of the upper mounting bracket 18 and the lower surface 20*d* rests down onto the upper end of the lower mounting bracket 18. In a preferred embodiment, the lower surface 20*d* of shelf 20 has a depression, cavity, or channel or otherwise formed indentation formed therein which corresponds to the location of the locking ridge 24 on the lower mounting bracket 18. Thus, with shelf 20 slid along trajectory "b" between the upper and lower mounting bracket 18, and so as to align the indentation in the lower surface 20*d* of shelf 20 with the locking ridge 24 of the lower mounting bracket 18, as shelf 20 is lowered in direction "c" from an inclined position during which it is inserted along trajectory "b" between the upper and lower mounting brackets, to a horizontal resting position, locking ridge 24 mounts into the indentation in the lower surface 20*d* of shelf 20 thereby inhibiting shelf 20 from being slid, inadvertently outwardly from between uprights 10. When it is desired to remove shelf 20 from between uprights 10, shelf 20 is rotated upwardly in a direction reversed to direction "c" so as disengage the indentation on the lower surface of the shelf from the locking ridge 24 on the lower mounting bracket, and once the shelf is in an inclined position, the shelf may be then removed in a direction opposite to direction "b" so as to lift and slide shelf 20 from between the upper and lower mounting brackets. If a user wishes then to reposition shelf 20, the fasteners such as screws 26 are removed from base member 18*a* on each mounting bracket 18, and the mounting brackets 18 removed from uprights 10 and repositioned into the desired hole groups 14 so as to then allow reinsertion of shelf 20 in its new position along uprights 10.

Thus as will be understood by one skilled in the art, a shelving system may be modularly constructed and expanded to suit the available space by adding more uprights 10 to form a parallel spaced apart array, spaced apart by the length of cross members 12 so that shelves 20, or for example shoe storage panels 28 or storage cubes 30 or drawer housings 32 housing drawers 32*a* may be mounted at desired heights along and between desired pairs of uprights 10.

The storage space provided between, for example, a pair of panels 28 which are aligned one on top of the other, is dictated by the spacing "d" between an upper pair of mounting brackets supporting the upper panel 28 and the lower pair of mounting brackets 18 supporting the lower panel 28. Similarly spacing "d" then governs the spacing between pairs of shelves 20 which are one on top of the other, and the spacing between adjacent drawer supports 32*b* which are one on top of the other, each drawer support 32*b* slideably supporting a drawer 32 suspended thereunder for example on rails 32*c*. In the case of drawer housings 32, the planar drawer supports are supported at the rear ends thereof between pairs of upper and lower mounting brackets 18. The drawer housings are then formed by side panels depending downwardly from the side edges of each planar drawer support 32*b* so as to enclose the corresponding drawers 32*a*.

In the case of panels 28, the rear-most ends 28*a* of each panel 28 are angled relative to the forward and 28*b* so that the rear ends 28*a* may be mounted in a horizontal aspect between pairs of mounting brackets 18, and, when so supported, the forward end 28*b* extends cantilevered outwardly from uprights 10 in at a downwardly inclined angle so as to support therein, for example, pairs of shoes resting against a rail 28*c* mounted at the forward-most and lower end of panel 28.

In one embodiment, especially where shelves 20 are expected to be relatively heavily loaded, bracing struts 34 may be mounted for example, inclined at a 45 degree angle relative to uprights 10 so as to brace the mid-section 20*e* of shelf 20. In particular, the upper end of each strut 34*a* mounts into a corresponding aperture formed in lower surface 20*d* at mid-section 20*e*, and a lower end of strut 34*b* is for example angled at 90 degrees so as to insert into an available hole 16*a* in a hole group 14 directly beneath the hole group 14 into which the lower mounting bracket 18 is mounted which is supporting the lower surface 20*e* of shelf 20.

In one embodiment, a suspended bar or rod 36 is mounted suspended from lower surface 20*d*.

Storage cubes 30 may be mounted to so as to be suspended from a planar cube support 30*a*, the rear end of which is mounted between a corresponding pair of mounting brackets 18. The cube housing 30*b* is mounted to the underside of cube support 30*a* so as to extend it downwardly along uprights 10. It will thus be understood that, and without intending to be limiting, the system accessories, such as shelves 20, panels 28, storage cubes 30, and drawers 32, may be positioned wherever a user desires between corresponding pairs of uprights 10.

Where adjacent shelves 20 extending between three adjacent uprights 10 are co-planar with each other, a connector clip "H"-38 may be inserted into the gap between the adjacent ends of the pair of shelves 20 so as to support the adjacent ends of the shelves relative to one and other and also to provide for example downwardly-depending hooks 38*a* for use by the user. Clip 38 has on each side thereof a U-shaped rim 38*b* defining a channel on opposite sides of clip 38 into which the adjacent ends of the adjacent pair of shelves 20 may be slid.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A storage system comprising:

at least first and second uprights wherein each upright of said first and second uprights has vertically extending front and rear edges and a pair of side faces extending between said front and rear edges, and wherein a spaced apart array of substantially identical groups of holes are formed along at least one of said pair of side faces on each said upright, and wherein each group of said groups of holes includes at least one receiving stub-shaft receiving aperture and one fastener aperture, and wherein said groups of holes in said array are alternatingly staggered along each of said uprights so that, counting downwardly from an uppermost first said group located adjacent said rear edge of said each upright, a second said group is located adjacent said front edge and at an elevation which is lower than said first group by a first vertical spacing, and wherein a third said group is located adjacent said rear edge and at an elevation which is lower than said second group by a second vertical spacing, said second vertical spacing greater than said first vertical spacing, and wherein a fourth said group is located adjacent said front edge and at an elevation which is lower than said third group by said first vertical spacing, a plurality of sets of mounting brackets wherein each set of mounting includes at least four mounting brackets and wherein each mounting bracket within each set of said mounting brackets includes a base member, a stub-shaft extending from said base member, and at least one fastener aperture, wherein said stub-shaft is sized for snug fitment into said stub-shaft receiving apertures, and wherein said base member, when mounted against a corresponding said side face of a corresponding said upright with said stub-shaft journalled fully into a corresponding said stub-shaft receiving aperture, and with a fastener mounted through said fastener aperture and into corresponding said fastener receiving aperture, has an upper end and an opposite lower end, at least one planar panel having a pair of side edges at opposite sides thereof wherein each side edge has an indentation formed on said panel adjacent a corresponding said side edge; a rear edge and an opposite front edge of said panel extending between said pair of side edges, and wherein at least one of said upper and lower ends of said base member has a protuberance thereon which mates into a corresponding said indentation on said panel, wherein, with one set of mounting brackets mounted to corresponding said first and second groups of holes, and with said rear edge of said panel inserted between said mounting brackets when mounted into said first and second groups of holes, said panel having a thickness so as to snugly fit into said first vertical spacing, and with said rear edge of said panel substantially flush with said rear edges of said uprights, an upper surface of said panel adjacent said rear edge of said panel abuts upwardly against said lower ends of said mounting brackets mounted to said first set of holes, and a lower surface of said panel adjacent said rear edge of said panel abuts downwardly against said upper ends of said mounting brackets to mount to said second set of holes, and said protuberances mated into said corresponding said receiving indentation on said panel.

2. The system of claim 1 wherein said each vertical upright is a beam, and wherein said panel includes a shelf, and wherein said first vertical spacing is substantially the shelf thickness, and wherein said second vertical spacing includes spacing between a vertically adjacent pair of said shelves.

3. The system of claim 2 wherein said beam is substantially a rectangular parallelepiped, and wherein said each groups of holes includes at least two vertically spaced apart holes.

4. The system of claim 3 wherein said holes are substantially vertically aligned one over the other.

5. The system of claim 2 wherein each group of holes includes at least three vertically spaced apart holes.

6. The system of claim 5 wherein a centre hole of said holes is said stub-shaft receiving aperture.

7. The system of claim 1 wherein said protuberance is only on said upper ends of said base members.

8. The system of claim 7 wherein said protuberance is a nub-like projection.

9. The system of claim 7 wherein said projection is a ridge extending transversely of said base member when mounted to said upright so that said ridge extends outwardly of a corresponding side face of said upright.

10. The system of claim 1 wherein said set of mounting brackets includes two opposed-facing pairs of said mounting brackets mounted to opposed-facing said side faces on said uprights.

11. The system of claim 10 wherein said apertures are bores extending completely through said uprights.

12. The system of claim 10 wherein said beam has a beam thickness extending completely through said beam from one said side face to the other said side face, and wherein said beam has a length from a top end of said beam to a bottom end of said beam, and wherein said beam has a depth orthogonal to said thickness of said beam and said length of said beam, and wherein said front and rear edges are spaced apart by said depth, and wherein said two opposed-facing pairs of said mounting brackets include an upper pair of mounting brackets and a lower pair of mounting brackets, and wherein said upper and lower pairs of mounting brackets are spaced apart across said beam by substantially said depth.

13. The system of claim 12 wherein said panel is a planar shelf extending between a pair of said uprights and cantilevered from said uprights by substantially a corresponding depth of said shelf.

14. The system of claim 13 wherein said shelf is cantilevered substantially horizontally.

15. The system of claim 13 wherein a plurality of said shelves are mounted between corresponding said sets of mounting brackets mounted to said apertures in said uprights.

16. The system of claim 15 further comprising additional said uprights and additional said shelves mounted to, so as to extend between adjacent said uprights on corresponding sets of brackets.

* * * * *